US005379541A

United States Patent [19]

Bammate

[11] Patent Number: 5,379,541

[45] Date of Patent: Jan. 10, 1995

[54] AUTOMATIC OR SEMIAUTOMATIC FIREARM

[75] Inventor: Timour Bammate, Paris, France

[73] Assignee: Marianne Bammate, Paris, France

[21] Appl. No.: 3,748

[22] Filed: Jan. 13, 1993

[30] Foreign Application Priority Data

Mar. 26, 1992 [CH] Switzerland ..... 00964/92

[51] Int. Cl.[6] ..... F41A 9/70

[52] U.S. Cl. ..... 42/7; 42/18

[58] Field of Search ..... 42/7, 18; 89/137, 138

[56] References Cited

U.S. PATENT DOCUMENTS

| | | | |
|---|---|---|---|
| 657,918 | 9/1900 | Copping et al. | 42/7 |
| 804,984 | 11/1905 | Searle | 42/7 |
| 875,209 | 12/1907 | Prinke | 42/18 |
| 886,211 | 4/1908 | Hino et al. | 42/7 |
| 904,646 | 11/1908 | Prinke | 42/18 |
| 1,130,312 | 3/1915 | Mauser | 42/7 |
| 1,992,380 | 2/1935 | Linder | 42/18 |
| 2,765,558 | 10/1956 | Roper et al. | 42/18 |

FOREIGN PATENT DOCUMENTS

| | | | |
|---|---|---|---|
| 3035796 | 5/1982 | Germany | 42/7 |

*Primary Examiner*—Stephen M. Johnson

*Attorney, Agent, or Firm*—Anthony J. Casella; Gerald E. Hespos

[57] ABSTRACT

The firearm comprises a manual control (13) for deactivation of the retainer of a cartridge magazine (8) by release of a tooth (16) from a notch (17) of the magazine and a device for the automatic ejection of the magazine. The automatic ejection device comprises a finger (25) for the actuation of the tooth (16), which is integral with the cartridge elevator piston (19) of the cartridge magazine (8), to come against the retainer of the latter and cause its ejection before the end of the elevation stroke of the cartridge elevator piston during the chambering of the last cartridge (12) under the thrust of the spring (20) of this piston against an activation spring (18) of the retainer. After the ejection of the empty cartridge, the retainer (13) is again activated by its spring (18) and, during the replacement of this magazine, a cartridge (12) is thus chambered and the firearm is ready to fire.

2 Claims, 2 Drawing Sheets

1
2
3
4
6
7
8
9
10
11
12
13
14
15
16
17
18
19
20
23
24
25
26

AUTOMATIC OR SEMIAUTOMATIC FIREARM

BACKGROUND OF THE INVENTION

1. Field of the Invention

The object of the present invention is an automatic or semiautomatic firearm comprising a frame, a removable cartridge magazine in the frame, a cartridge elevator piston which is movable in the magazine, a spring in the magazine to raise the elevator piston by continuous pressure, temporary retainer of the magazine in the frame activated by engagement in a notch provided in the wall of the magazine, a manual control to deactivate the retainer of the magazine and free the magazine when desired, a barrel close to the frame, a firing chamber forming a continuation of the barrel and intended to receive a cartridge from the magazine, a breech block movable back and forth on the frame and comprising means in order, after each firing of a cartridge, to extract the case of the cartridge fired from the chamber during its recoil and then during its return displace another cartridge from the magazine up to the firing chamber, and this up to the last cartridge of the magazine, at the end of the elevation stroke of the cartridge elevator piston.

2. Description of the Prior Art

In the known firearms of this type, such as, for instance, semiautomatic pistols, assault rifles and automatic pistols shooting in bursts, means are provided to facilitate and make easier the manipulations required of the user for the evacuation and replacement of a cartridge magazine, in order to check the number of cartridges remaining in his magazine, as well as to warn him of the exhaustion of then after the firing of the last cartridge.

These means comprise the retainer of the cartridge magazine and its deactivation control, which have already been mentioned, and, on many of these known firearms, a breech block lock, namely a mechanism adapted to keep the breech block open in recoil position after the firing of the last cartridge of the magazine.

The retainer of the cartridge magazine consists of a lever having a stop, which, under the continuous pressure of a spring, engages in a retention notch in the wall of the magazine upon arrival of the magazine in the intended place in the frame.

The deactivation control for the retainer of the magazine generally consists of a simple extension of the lever of said retainer out of the frame, said extension having at its end a pressing surface for the thumb or index finger of the user, particularly when said control is arranged in the immediate vicinity of the trigger of the firearm, at the top of the stock, for ergometric reasons. By pressing said surface against the pressure of the spring of the retainer, the stop of the latter is disengaged from the notch of the magazine, and the latter is freed and can be removed from the frame. The user can thus, at any time, remove the magazine from his firearm, not only to check the number of cartridges remaining or to replace it by another magazine, but also for reasons of safety, such as, for instance, in a stop-fire situation or in the event of the jamming of the firearms.

The breech block lock is a lever with return spring having a stop intended to engage in a retention notch in the movable breech block in order to maintain the breech block open in the recoil position. The engaging of this stop in the retention notch of the breech is produced on the one hand, first of all, by application of the thrust of the cartridge elevator piston against the breech block lock after the chambering of the last cartridge of the magazine in the firing chamber and, on the other hand, in a second step, by penetration of said stop, under the effect of this thrust, into the retention notch of the movable breech block, slightly before the end of the recoil movement of the breech block resulting from the firing of the last cartridge.

After the firing of the last cartridge, the fact that the breech block remains open in recoil position avoids the need of the user of count the shots in order to know when the cartridge magazine has been exhausted, permits, on the firing range, visual verification from a distance that the firearm is actually empty and out of operation, and also avoids having the user find himself with the breech block closed and the firearm ready to fire on an empty firing chamber, which situation is disturbing for precision firing and definitely dangerous in combat. Furthermore, the fact that the breech block remains open may contribute to the cooling of the barrel.

After introduction of a new cartridge magazine, the user pulls the breech block back slightly more to the end of its recoil stroke in order to free the stop of the breech block lock from the retention notch in the breech, it moving away under the effect of the return spring and allows the breech block to start forward again in order to introduce the first cartridge from its magazine into the firing chamber, the firearm being thus again ready to fire.

In combat situation, it is obvious that the manipulations required by the changing of the cartridge magazine constitute a handicap for the user. The trend has therefore always been to seek means which make it possible to minimize this handicap.

Thus, in certain pistols, means are provided so that the putting in place of a new magazine triggers the return of the breech block, which has remained open after the firing of the last cartridge of the previous magazine and thus causes the chambering of the first cartridge of this new magazine.

The user is thus freed from the necessity of manipulating the breech block in order to chamber this first cartridge, and he no longer has to concern himself with deactivating the retainer of the empty magazine before replacing it by a new magazine.

However, this manipulation, which is necessary for the release of an empty cartridge, which by its nature uses the thumb or index finger of the hand of the user, results in a change in the manner in which the pistol is held in one's hand, which again is a handicap in a precision firing situation.

However, the fact that the breech block remains open in recoil position after the firing of the last cartridge of the magazine has only advantages.

In fact, while this indication of the arrival at the end of the cartridge magazine is useful on the firing range as a matter of safety and in order to avoid the user finding himself ready to fire on an empty chamber, it is less so in combat situations, and may even become disturbing when facing the adversary.

OBJECTS AND SUMMARY OF THE INVENTION

The object of the present invention is further to minimize the handicaps inherent in the manipulations required by the operations of changing the cartridge magazine of a firearm and thereby to increase the firing power of said firearm.

For this purpose, the firearm of the invention, of the type described at the beginning hereof, is characterized by the fact that it comprises, in addition to the manual control for deactivating the retainer of the cartridge magazine, a device for the automatic ejection of the latter from the frame, comprising an actuating finger for the retainer of the magazine associated with the cartridge elevator piston, related to the displacement in height of the latter and placed in a position adapted to come against and deactivate the retainer of the magazine under the pressure of a spring at the earliest during the displacement of the last cartridge from the magazine by the movable breech and before the arrival of the cartridge elevator piston at the end of its elevation stroke, and a cocking spring the action of which, used and intended to expel the magazine from the carcass, is triggered by the deactivation of the retainer of the magazine.

In this way, and due to the device for the automatic ejection of the cartridge magazine thus designed, the user is freed from the necessity of manipulating the control for the deactivation of the retainer of an empty magazine before being able to replace it, since the empty magazine is ejected automatically during the displacement of its last cartridge by the movable breech block, during the return of the breech block as a result of the firing of the next-to-the-last cartridge.

Since this device is provided in addition to the manual control for the deactivation of the retainer of the magazine, the retainer is always ready to operate and the user does not lose the possibility of withdrawing the magazine at any time and for any reason whatsoever.

Furthermore, as the last cartridge of the ejected magazine is introduced into the firing chamber by the movable breech block, this has a result that, during the introduction of the new loader, a cartridge is chambered and the firearm is ready to fire with it.

As a result hereof, the user no longer has to change the manner in which he is holding his firearm in order to change the cartridge magazine, which eliminates the handicap relative to the precision of his firing; he no longer has to manipulate the movable breech block in order to chamber the first cartridge of the new magazine, and, in particular, during the time necessary for the introduction of the new loader of his firearm he is, nevertheless, ready to fire in case of need, which cannot be obtained with the known firearms equipped with means for automatically changing the first cartridge upon the putting in place of the new magazine.

A substantial reduction is thus obtained in the handicaps inherent in the operations of changing the cartridge magazine, which results in an increase in the firing power of the firearm, which is clearly in accord with the purpose of the invention.

One interesting consequence of the arrangement of this firearm, which results from what has just been stated, is that it is no longer necessary to equip it with a breech block lock.

In fact, while the user is replacing the cartridge magazine upon its automatic ejection, the movable breech block can never close again on a firing chamber which does not contain a cartridge, as is to be feared with the presently known firearms which are not equipped with a breech lock, and the visual signal given of arrival at the end of the magazine is therefore not eliminated since this signal is provided here by the ejection of the empty cartridge . . . on a firearm, however, which is ready to fire!

But on the firing range, it may be desired that a firearm in accordance with the invention have a breech block which remains open in recoil position after the firing of the last cartridge of the magazine, for the reason of safety already pointed out. This arrangement may also be desired in order to facilitate the cooling of the barrel.

The design of the device for the automatic ejection of the cartridge magazine makes it possible to satisfy this desire without requiring any special adaptation of the structure or operation of the breech lock.

BRIEF DESCRIPTION OF THE DRAWINGS

The accompanying drawing shows, by way of example, two embodiments of the object of the invention.

DETAILED DESCRIPTION OF THE PREFERRED EMBODIMENTS

Figures 1, 2, 3, 4, 5, 6:
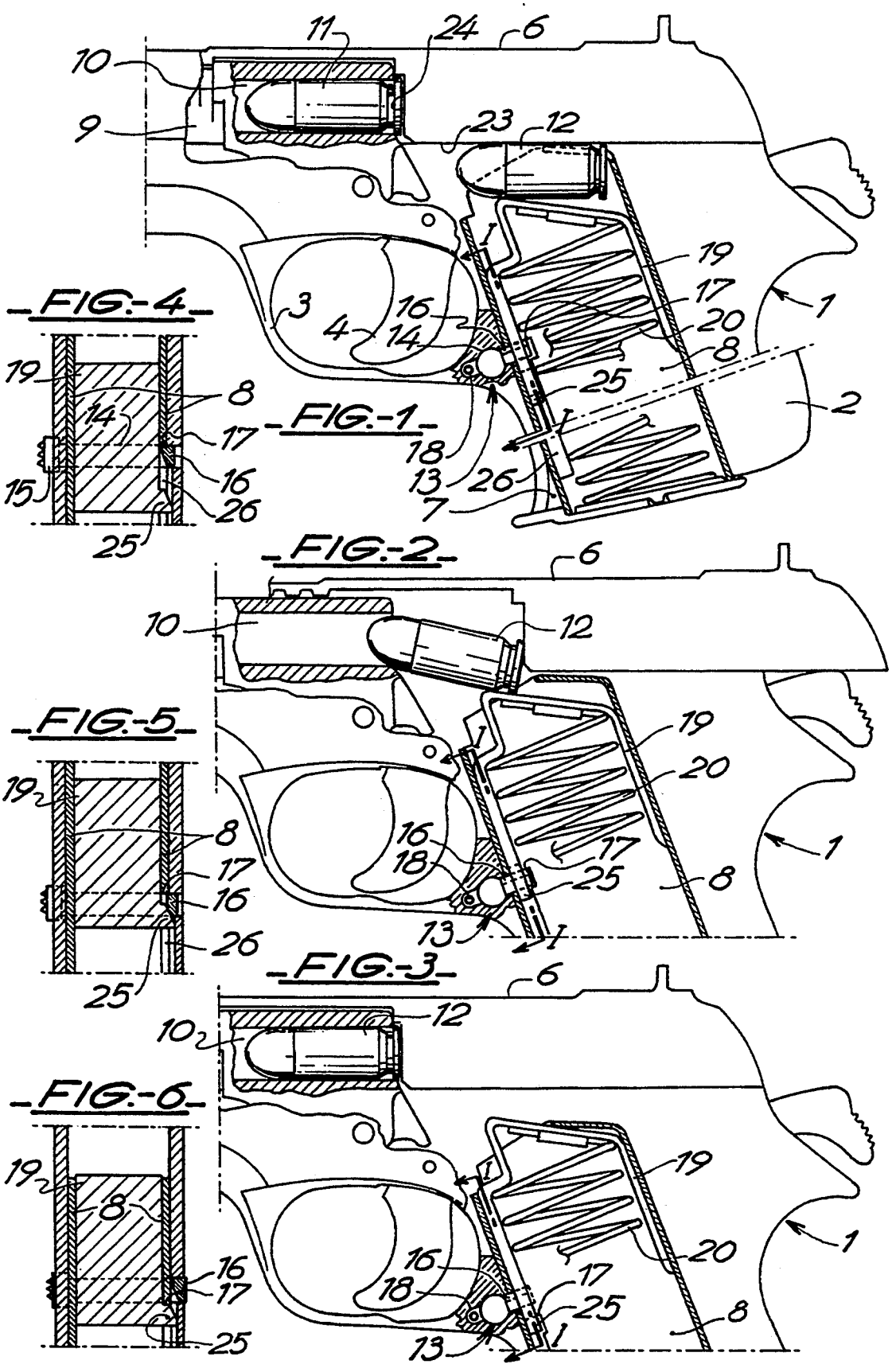
FIGS. 1, 2 and 3 are three partial profile views, in partial section, of the first embodiment, shown in three different phases respectively of its operation.
FIGS. 4, 5 and 6 are three partial sections along the same section axes I—I of FIGS. 1, 2 and 3, respectively.
Figure 7:
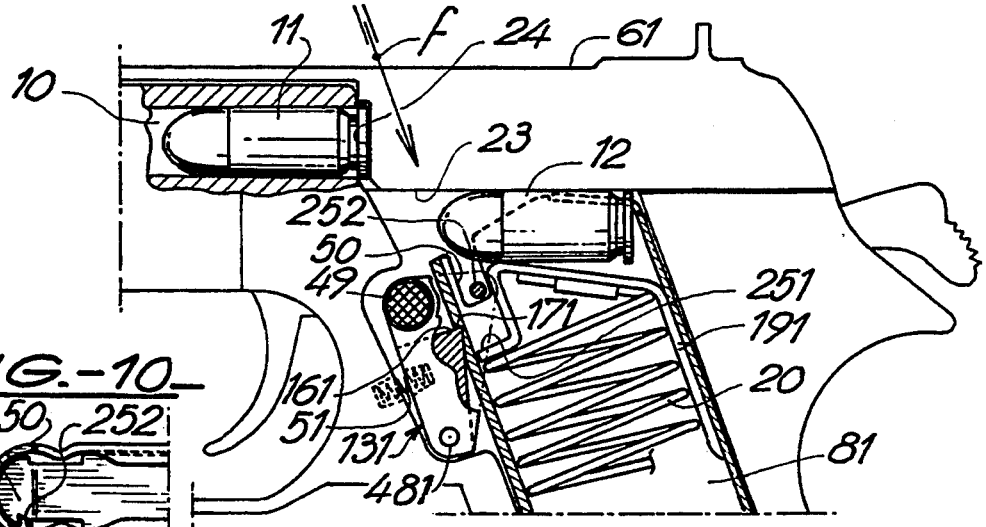
FIGS. 7, 8 and 9 are three partial profile views, in partial section, of the second embodiment, shown in three different phases respectively of its operation.

The firearm shown in the six FIGS. 1 to 6 of the first embodiment is a semiautomatic pistol which operates without breech block lock, but it is obvious that its inventive features are applicable to any other type of automatic or semiautomatic firearm, whether or not equipped with a breech lock.

This firearm has a frame 1 forming a stock 2, a guard 3 for a trigger 4, and a movable breech block 6.

The frame 1 comprises:

- a housing 7 in the stock 2, intended to house a removable cartridge magazine 8;
- a barrel 9 on the frame 1, associated with the latter;
- a firing chamber 10, shown in cross section, forming a continuation of the barrel 9 for chambering a cartridge 11, 12 of the magazine;
- a temporary retainer 13 of the cartridge magazine 8, formed here by a rod 14 which passes through the frame and has on one side, on the outside, a push-button 15 and on the other side, on the inside, a retention tooth 16 intended to engage in a notch 17 in the wall of the cartridge magazine 8 under the thrust of an inner activating spring 18 parallel to the rod 14;
- a manual control for deactivating the retainer of the magazine 13, formed here by the push button 15;
- a mechanism for the firing of a chambered cartridge, connected to the trigger 4, which has not been shown here in order not needlessly to complicate the drawing and which may be of any suitable type; and
- a device for the automatic ejection of the cartridge magazine 8 which characterizes the invention and which is described below.

The cartridge magazine 8 has a cartridge elevator piston 19 which is subjected to the continuous pressure of a compression spring 20 which rests against the bottom of said magazine.

The breech block 6, which is movable back and forth on the frame 1, comprises the customary means for—after each firing of a cartridge—extracting from the firing chamber, during its recoil, the case of the cartridge fired and displacing and then introducing, during its return, another cartridge from the magazine 8 up to the firing chamber 10, doing this until the last cartridge, at the end of the upward stroke of the elevator piston 19. Among these means, there are shown here a resting ramp 23 for the cartridge debouching from the magazine 8 and a front wall 24 of the breech block 6 intended to intercept this cartridge and transfer it into the firing chamber 10 after the recoil of the breech block 6 upon the firing and during its return. From the front wall 24 there protrudes the firing pin of the cartridge, which pin has not been shown.

In this first embodiment, the device for the automatic ejection of the cartridge magazine comprises:

an actuating finger 25 for the tooth 16 for the retention of the cartridge magazine 8, connected to and associated with the cartridge elevator piston 19 by integration on the shapes of the latter, the active wedge-shaped part of which is engaged in and protrudes from a slideway 26 of the wall of the cartridge magazine in order to come against and actuate the tooth 16 of the retainer 13 of the magazine under the thrust of the spring 20 of the cartridge elevator piston 19. The position of this finger 25 on the cartridge elevator piston 19 is such as to come against and deactivate the retainer of the magazine 13 during the displacement of the last cartridge 12 of the magazine by the movable breech block 6 before the arrival of the cartridge elevator piston 19 at the end of its elevation stroke;

a cocking spring, the role of which is filled here by the spring 20 itself for the pushing of the cartridge elevator piston 19.

The operation of this automatic ejection device for the cartridge magazine 8 shown in FIGS. 1 to 6, is as follows:

In the phase shown in FIGS. 1 and 4, the pistol is ready to fire the next-to-the-last cartridge 11, which has already been introduced into the firing chamber 10, and the last cartridge 12 of the magazine 8 is pressed by the elevator piston 19, under the action of the spring 20, against the ramp 23 of the movable breech block 6.

The tooth 16 of the retainer 13 of the cartridge magazine 8 is engaged in the notch 17 of the magazine as a result of the spring 18, thus maintaining the said magazine in place in the frame 1.

The phase shown in FIGS. 2 and 5, which is after the firing of the next-to-the-last cartridge 11, is that during which the last cartridge 12 is displaced and is being introduced into the firing chamber 10, by return of the breech 6, just after the finger 25 of the cartridge elevator piston 19 comes into contact with the tooth 16 of the retainer 13 of the cartridge magazine 8, the latter being then retained by said tooth 16. It may be noted here, in passing, that the inclination of the active end of the wedge-shaped finger 25 is identical to that of the face of the tooth 16 acted on by said finger. However, this is not indispensable and the contact can take place on a corner or rounding of the tooth 16.

Practically at the same instant, before the first cartridge 12 is chambered in the firing chamber 10 and before the elevation piston 19 arrives at the end of its upward stroke in the cartridge magazine 8, the finger 25 of the cartridge elevation piston 19, under the thrust of the spring 20 by wedge effect of its active end, moves the retention spring 16 away from the retention notch 17 of the cartridge magazine 8 and frees the latter from said retention.

Simultaneously with this release, the elevator piston 19 still resting against the last cartridge 12 but not yet having arrived at the end of its upward stroke, the spring 20 is still cocked over a residual upward stroke and it thereby pushes the cartridge magazine 8 downward by reaction.

And this leads immediately to the phase shown in FIGS. 3 and 6, in which the last cartridge 12 is introduced completely into the chamber 10 by complete return of the breech block 6, and during which the cartridge magazine 8 is ejected from the firearm after having experienced the reactive thrust of the spring 20.

Of course, the relative positions of the finger 25 of the elevation piston and of the retention notch 17 of the magazine, as well as the ratio of the forces of the springs 18 and 20, are so determined that the magazine 8 is freed from its retainer by the finger 25 slightly before the end of the upward stroke of the cartridge elevation piston 19 and while the latter is still resting against the cartridge 12, during the transfer of the latter.

At the end of this phase, and after ejection of the cartridge magazine 8, the retainer 13 is again cocked by its spring 18, ready to retain a new cartridge magazine, while the last cartridge 12 is chambered and ready to be fired.

The chambering of the first cartridge of the new magazine then takes place automatically upon the firing of the cartridge 12, upon return of the movable breech block 6, without it being necessary to manipulate the latter.

It will be noted that it remains possible at any time to free the cartridge magazine 8 by pressing on the push button 15, independently of the operation itself of the automatic election device.

It is also of interest to note that, in this first embodiment, the only two springs used to assure the operation of this device are those of the cartridge elevator piston 19 and of the retainer 13.

Finally, there is now clearly evident the aforementioned lack of necessity to use a breech lock in order to maintain the breech block 6 open after the firing of the last cartridge 12, either as means of signaling the arrival at the end of the cartridge magazine since this is signalized by the ejection of said magazine, or as means for making it possible to avoid the movable breech block 6 being moved back on an empty firing chamber 10 since, after ejection of the empty magazine and during the putting in place of a new magazine, the last cartridge 12 of the ejected magazine is chambered in the firing chamber 10.

However, while retaining the basic characteristics of the automatic cartridge ejection device, it is possible, as already indicated at the start hereof, to apply it to a firearm equipped with a breech block lock when this is deemed advisable, as for instance when the firearm is used on a firing range, as a matter of safety or for the cooling of the barrel, and this without the need of adaptations of the breech lock.

The second embodiment, shown in FIGS. 7 to 11, makes it possible to obtain the same effect as in the first embodiment, but here with a retainer 131 of the cartridge magazine formed by a lateral lever which integrates in its structure a drive stop 252 associated with a retention tooth 161, these two elements being spaced from each other.

The operation of the other parts which have already been shown and described in the first embodiment is identical and reference will be had to the description of said first embodiment, in particular with regard to the sequential operation of the movable breech block 61 and of the cartridge elevator 191, which corresponds to that of the breech block 6 and of the elevator 19, the thrust spring 20 of the elevator piston 191 acting here also as cooking spring for the automatic ejection device for the cartridge magazine 81.

The retainer 131 of the cartridge magazine 81 is, for instance, of triangular profile having at its lower vertex an articulation pin 481, at its right upper vertex, on the side of the magazine 81, a finger parallel to said axis forming the aforementioned drive stop 252, and at its third vertex a knurled button 49 for manual control. Between the articulation pin 481 and the drive stop 252 there is located the retention tooth 161, in position offset towards the front of the firearm with respect to a fictitious flange joining the pivot axis 481 to the axis of the drive stop 252 so as to facilitate its release from a retention notch 171 in the wall of the cartridge magazine 81 upon the automatic ejection action.

Opposite the retaining tooth 161 there is placed a spring 51 for actuation of the retainer 131 of the magazine intended to engage said tooth in the retention notch 171 of the cartridge magazine upon the placing thereof in the firearm.

Figure 10:
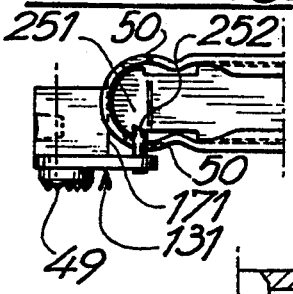
FIG. 10 is a partial top view of the second embodiment, seen in the direction f of FIG. 7.

The cartridge magazine 81 has a vertical notch 50 in its two side walls contiguous to its rounded front wall, in one of which the stop 252 of the retention lever 131 engages when it is placed in the firearm, as can be readily noted from FIG. 10.

Figure 8:
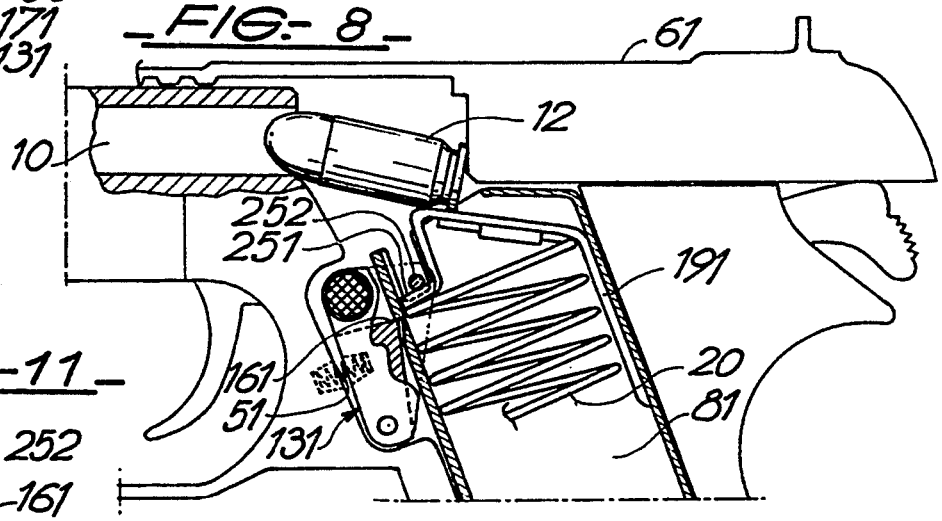
Figure 11:
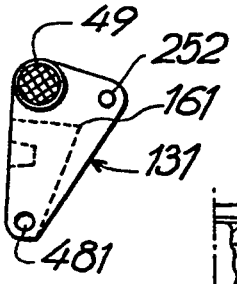
FIG. 11 is a profile view of a part contained in the second embodiment.

The cartridge elevator piston 191 in this case has a finger 251 for actuation of the retainer 131 formed by a return of its upper wall constituting a blade intended to come against the drive stop 252 of said retainer 131 before arriving at the end of its upward stroke in the magazine 81, in the configuration shown in FIG. 8.

The automatic ejection of the cartridge magazine 81 takes place here in accordance with the same sequences as in the first embodiment.

This automatic ejection takes place during the transfer of the last cartridge 12 from the magazine 81 to the firing chamber 10 in a position which immediately follows that shown in FIG. 8 and while the cartridge elevator 191 is still resting against said cartridge and is still suffering the pressure of the spring 20. At this time, the drive finger 251 of the cartridge elevator 191 pushes the drive stop 252 of the retainer 131 upward, which has the effect of causing said retainer to pivot around its axis 481 and against its spring 51 and disengaging its retention tooth 161 from the retention crane 171 of the cartridge magazine 81.

Figure 9:
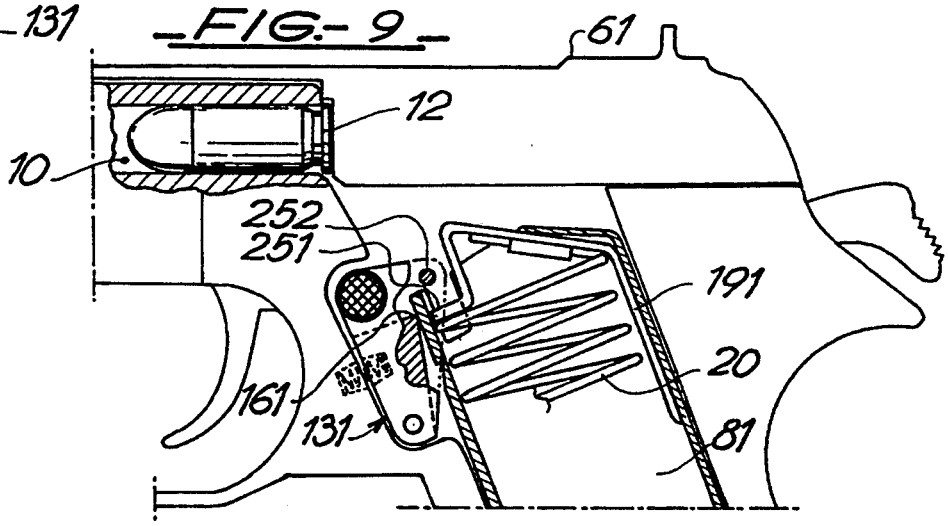

Under the effect of the force of reaction of the spring 20 and during the course of its remaining stroke in the cartridge magazine 81, the latter is pushed downward out of the firearm while the last cartridge 12 is fully introduced into the firing chamber 10 by the complete return of the breech block 61, as shown in FIG. 9.

This second embodiment is simple and of great reliability due to the fact that it does not require too fine an adjustment. It is advantageously applied to firearms in which sufficient space can be reserved from the provision of a lock 131 of the type described between the housing of the cartridge magazine and the trigger.

Other changes, not shown, can be made without going beyond the scope of the invention.

Thus, for example, the activating of the automatic ejection of the cartridge magazine may comprise only a specifically suitable spring, or the use of an existing spring such as the spring 20 of the cartridge magazine of the first and second embodiments, or else a combination of these two systems.

I claim:

1. An automatic or semiautomatic firearm comprising:

a frame;

a barrel close to said frame;

a removable cartridge magazine in the frame;

spring actuated piston means movable in said cartridge magazine for feeding the barrel with cartridges inserted into the magazine;

notch means formed in a wall of said magazine;

latch means assembled to said frame for movement into first and second directions opposite to one another;

said latch means being a single rigid body rotating about a single axis;

spring means for urging said latch means into said first direction;

tooth means on said latch means, said tooth means for insertion into said notch means when said latch means are spring urged into said first direction;

manual control means on said latch means, said manual control means for urging said latch means into said second direction for withdrawing said tooth means from said notch means against the bias of said spring means; and drive means also on said latch means, said drive means for being directly urged by said piston means to move said latch means into said second direction and thereby withdraw said tooth means from said notch means.

2. An automatic or semiautomatic firearm comprising:

a frame;

a barrel close to the frame;

a removable cartridge magazine in the frame;

spring actuated piston means movable in said cartridge magazine for feeding the barrel with cartridges inserted into the magazine;

notch means formed in a wall of said magazine;

finger means formed on said piston means;

latch means assembled to said frame for pivotal movement therealong into first and second directions opposite to one another;

said latch means being a single rigid body rotating about a single axis;

spring means for urging said latch means into said first direction;

tooth means on said latch means, said tooth means for insertion into said notch means when said latch means are spring urged into said first direction;

manual control means on said latch means, said manual control means for urging said latch means into said second direction for withdrawing said tooth means from said notch means against the bias of said spring means; and drive means also on said latch means, said drive means located at a distance from said tooth means for being directly urged by said finger means to move said latch means into said second direction and thereby withdraw said tooth means from said notch means.

* * * * *